US010925402B2

(12) United States Patent
Coleman

(10) Patent No.: US 10,925,402 B2
(45) Date of Patent: Feb. 23, 2021

(54) DISASSEMBLED CHAIRS FOR SHIPMENT

(71) Applicant: Nexark, Inc., Los Angeles, CA (US)

(72) Inventor: Shloime Z. Coleman, Los Angeles, CA (US)

(73) Assignee: Nexark, Inc., Los Angeles, CA (US)

( * ) Notice: Subject to any disclaimer, the term of this patent is extended or adjusted under 35 U.S.C. 154(b) by 0 days.

(21) Appl. No.: 15/851,262

(22) Filed: Dec. 21, 2017

(65) Prior Publication Data

US 2019/0191882 A1 Jun. 27, 2019

(51) Int. Cl.
*A47C 4/02* (2006.01)
*A47C 3/04* (2006.01)
*A47C 7/42* (2006.01)

(52) U.S. Cl.
CPC ..... *A47C 4/028* (2013.01); *A47C 3/04* (2013.01); *A47C 4/02* (2013.01); *A47C 7/42* (2013.01)

(58) Field of Classification Search
CPC .. A47C 4/02; A47C 3/045; A47C 3/04; A47C 7/42; A47C 4/028; A47C 4/027; A47C 4/03; A47C 7/16; A47C 7/14
USPC ..... 297/440.15, 239, 440.1, 440.13, 17, 232
See application file for complete search history.

(56) References Cited

U.S. PATENT DOCUMENTS 1,408,114 A * 2/1922 Mathieu ..... A47C 3/04 108/91
1,735,851 A * 11/1929 Burton ..... A47C 4/021 297/440.13
2,699,814 A * 1/1955 Kahn ..... A47C 3/04 297/239
2,849,054 A * 8/1958 Shepherdson ..... A47C 4/52 297/17
2,876,828 A * 3/1959 Mayer ..... A47C 4/03 297/440.15
3,727,981 A * 4/1973 Ostroff ..... A47C 3/029 297/440.15
3,765,718 A * 10/1973 Chen ..... A47C 4/52 297/17
4,066,295 A * 1/1978 Severson ..... A47C 7/002 248/188
4,225,181 A * 9/1980 Lock ..... A47C 4/02 297/271.6
4,254,992 A * 3/1981 Orosa ..... A47C 5/02 297/134
4,913,496 A * 4/1990 Oke ..... A47C 3/04 297/297

(Continued)

FOREIGN PATENT DOCUMENTS

DE 9209949 U1 * 11/1992 ..... A47C 4/02
EP 0835619 A1 * 4/1998 ..... A47C 4/02

*Primary Examiner* — Milton Nelson, Jr.
(74) *Attorney, Agent, or Firm* — Hall Estill Attorneys at Law; Mitchell McCarthy

(57) ABSTRACT

A chair suitable for disassembly and a shipping method for the disassembled chair, which arranges chair parts of multiple chairs in one container and saves shipping cost. The disassembled chair has at least a backrest porting and a seat portion with extending legs, each of which has multiple connecting holes allowing them to be connected by mechanical fastener, such as rivets or screws. The seat portions of multiple chairs can be inverted and stacked within each other and multiple backrests can be located above the stacked seats between their legs, all within a single container so that the shipping and storing costs are lower.

12 Claims, 4 Drawing Sheets

(56) References Cited

U.S. PATENT DOCUMENTS

| | | | | | |
|---|---|---|---|---|---|
| 5,308,146 | A * | 5/1994 | Chou | A47C 3/04 | 297/118 |
| 5,356,204 | A * | 10/1994 | McDonough | A47D 1/006 | 297/181 |
| 5,678,892 | A * | 10/1997 | Heitlinger | A47B 9/00 | 248/188.5 |
| 6,135,562 | A * | 10/2000 | Infanti | A47C 7/40 | 297/440.14 |
| 7,434,276 | B2 * | 10/2008 | Cheng | A47K 3/282 | 297/17 |
| 7,708,349 | B2 * | 5/2010 | Chen | A47C 1/124 | 297/239 |
| D692,679 | S * | 11/2013 | Wei | D6/338 | |
| 9,033,414 | B2 * | 5/2015 | Olarte | A47C 3/04 | 297/239 |
| 9,282,807 | B1 * | 3/2016 | Carpenter | A45F 4/02 | |
| 9,820,576 | B2 * | 11/2017 | McCullough | A47C 4/02 | |
| 2003/0151292 | A1 * | 8/2003 | McLarty | A47C 4/02 | 297/440.15 |

* cited by examiner

DISASSEMBLED CHAIRS FOR SHIPMENT

FIELD OF THE INVENTION

The present invention relates generally to a chair that can be disassembled for less expensive shipment and, more particularly, the arrangements of chair parts of multiple disassembled chairs in one shipping container, e.g., chair backrests and chair seats, which can make the shipment of the disassembled chairs more efficient and less expensive.

BACKGROUND OF THE INVENTION

Disassembled, or ready-to-assemble, chairs have become more and more popular over the years. An assembled chair tends to occupy more space and thus is more expensive to store and to deliver. Disassembled chairs, however, allow manufactures to produce them by parts, and then to pack and ship them in a relatively smaller container. Typically, the more pieces a disassembled chair can be divided into, the more efficient its storage and shipping package can be. On one hand, manufacturing disassembled chairs essentially saves merchants' cost and eventually saves money for consumers. On the other hand, to save money, consumers have to assemble these chairs by themselves, perhaps with their own tools and limited guidance. Therefore, a goal for the merchants is to balance between a cost-saving practice by manufacturing disassembled chairs by as many parts as possible and a trouble-avoiding practice by not manufacturing the chairs in too many pieces so that the consumer can still successfully assemble the chairs themselves.

Conventionally, disassembled chairs comprise at least a chair backrest portion, a chair seat portion, and chair legs. This combination of parts enables the chairs to be packed into a "flat-pack" for efficient shipping and storage. The downside for this practice is that consumers have to assemble the chair legs to the seat, which is time consuming and can be unsafe if the leg assembly is not correct. There is, however, a contemporary strategy of manufacturing the chairs in the form of a backrest and a chair seat with the legs attached only. A major problem of this practice is that the chair cannot be packed into a "flat-pack" and therefore storing and shipping costs become higher.

Thus, it would be advantageous if there were a way of storing and shipping multiple disassembled chairs in one container so that eventually the cost could be reduced.

SUMMARY OF THE INVENTION

The present invention is directed to a new chair that can be disassembled and a method of shipping multiples of these chairs in a disassembled state in a single container.

The present invention has at least a backrest portion and a seat portion with attached legs. The backrest portion and seat portion each have multiple connecting holes, which allow them to be connected by mechanical fasteners, such as rivets or screws.

In a first step, one or more seat portions can be placed in a container of suitable size, with the seat surface facing downward, and the seat legs facing upward. Secondly, a first set of one or more backrest portion can be placed with its top portion resting at a top part of one side of the container and its bottom portion placed at the diagonal opposite of its top portion. Thus, the chair is designed so that the separation between its legs is greater than the width of the backrest.

In some embodiments, a second set of one or more backrest portions can be placed with their top portion close to another side of the container, preferably the opposite side to the side that the first set is placed, and its bottom portion placed at the diagonal opposite of the top portion. As a modification of this embodiment, a second chair seat with attached legs can be inverted and stacked inside the first chair seat prior to placing the second backrest portions in the container. Some necessary accessories, such as mechanical fasteners and shipping protections, shall be packed and attached to the shipment.

BRIEF DESCRIPTION OF THE DRAWINGS

The foregoing and other objects and advantages of the present invention will become more apparent when considered in connection with the following detailed description and appended drawings in which like designations denote like elements in the various views, and wherein.

DETAILED DESCRIPTION OF THE INVENTION

Figure 1A:
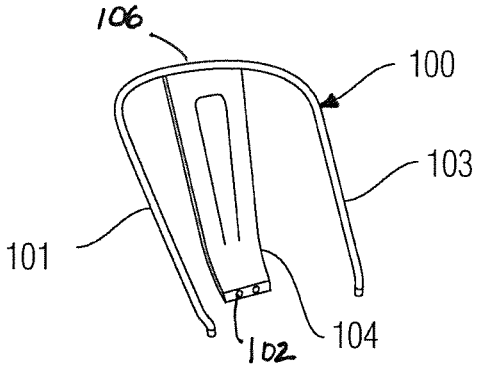
FIG. 1A shows a backrest portion of a disassembled chair according to the present invention.
Figure 1B:
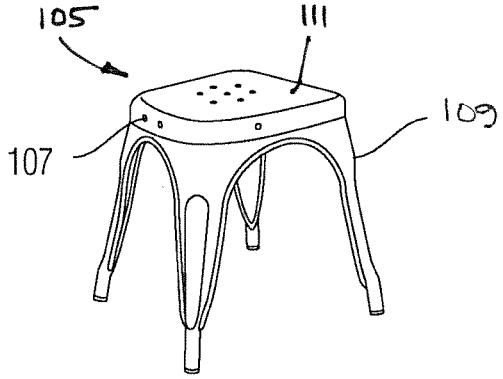
FIG. 1B shows a seat portion with extending legs of a disassembled chair according to the present invention.
Figure 1C:
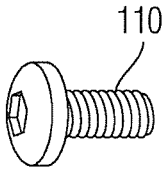
FIG. 1C shows a mechanical fastener according to the present invention.

The present invention relates to a device and a method for including one or more disassembled chairs in one shipment box or container. As shown in FIG. 1A, the chair of the present invention has a backrest portion 100. The backrest portion 100 has right tubular side portion 101 and left tubular side portion 103. In one embodiment, the backrest portion 100 can be in tubular shape. In some other embodiments, the backrest portion 100 can include an optional middle portion 104 that provides more back support to a user. Preferably, connection holes 102 are included in backrest portion 100, located at two ends of the backrest portion 100 as shown in FIG. 1A. A seat portion 105 forms a part of the chair of the present invention as shown in FIG. 1B. In some practical implementations, connection holes 107 are included near a top end of the seat portion 105, as shown in FIG. 1B. A mechanical fastener 110 is shown in FIG. 1C. Multiple mechanical fasteners 110 are included in the shipment to assist user's assembly process.

Figure 2A:
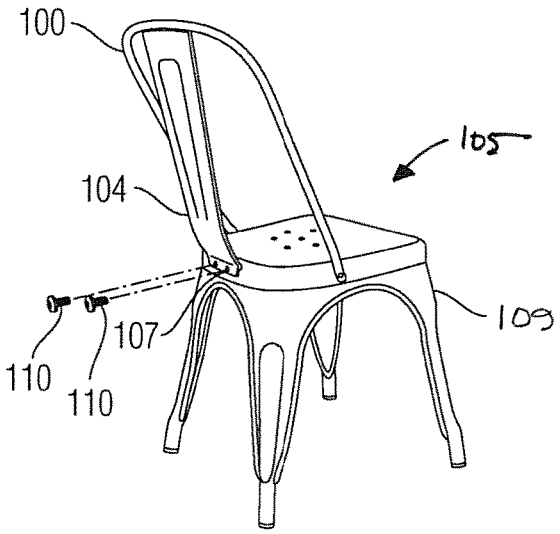
FIG. 2A shows the backrest portion and the seat portion partly connected by the mechanical fastener.
Figure 2B:
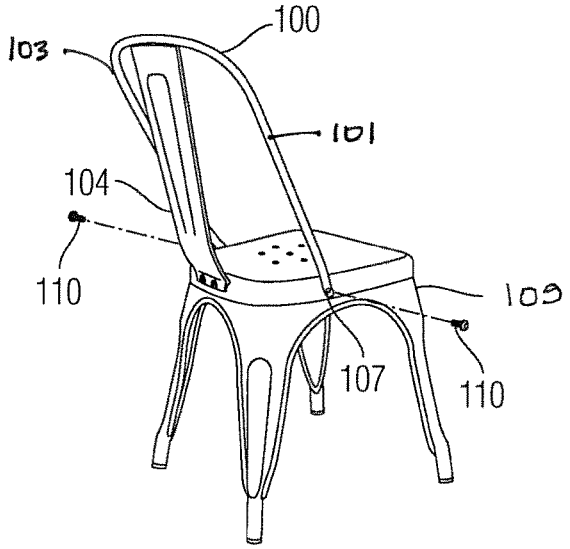
FIG. 2B shows the backrest portion and the seat portion fully connected by the mechanical fastener.

FIGS. 2A and 2B show an assembly method of the invention. FIG. 2A shows that the optional middle portion 104 is first fastened to the seat portion 105 by one or more mechanical fasteners 110. FIG. 2B shows that the tubular side portions 101 and 103 of the backrest portion 100 are fastened by at least one mechanical fastener 110 at each portion. The backrest portion 100 and the seat portion 105 are arranged in such a position that the connection holes 102 and 107 overlap, so that the mechanical fastener 110 can be used to fix the backrest portion 100 onto the seating portion 105. A practical implementation of the assembled chair is shown in FIG. 3.

Figure 3:
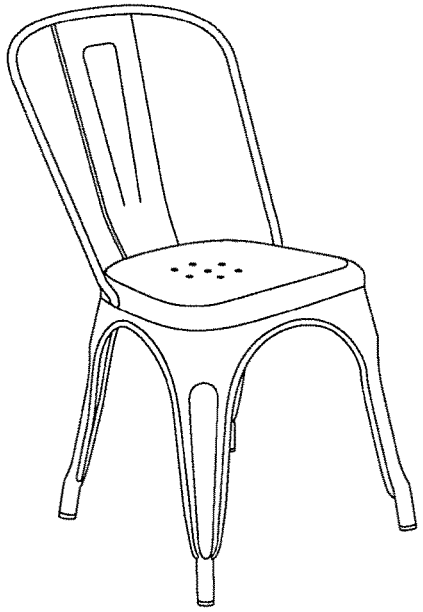
FIG. 3 is a perspective view of the assembled chair.
Figure 4A:
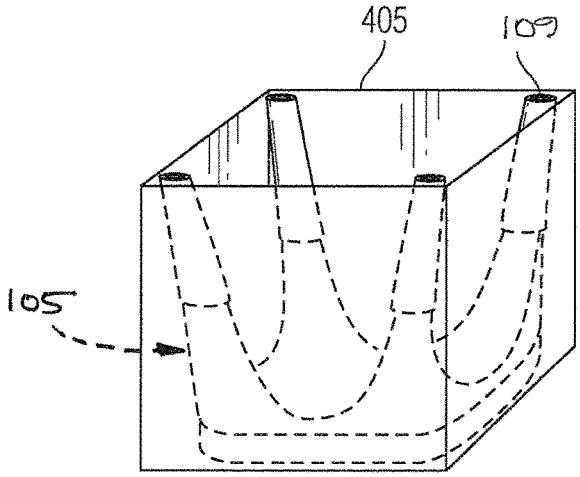
FIG. 4A is a perspective view of a seat portion with its seating surface facing downward in an open box or container.
Figure 4B:
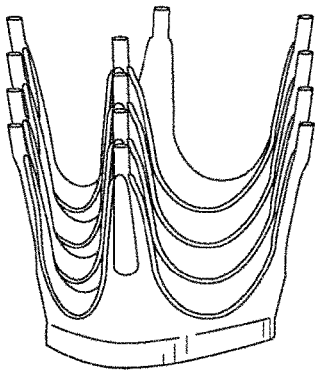
FIG. 4B is a perspective view of multiple seat portions stacked together.
Figure 5:
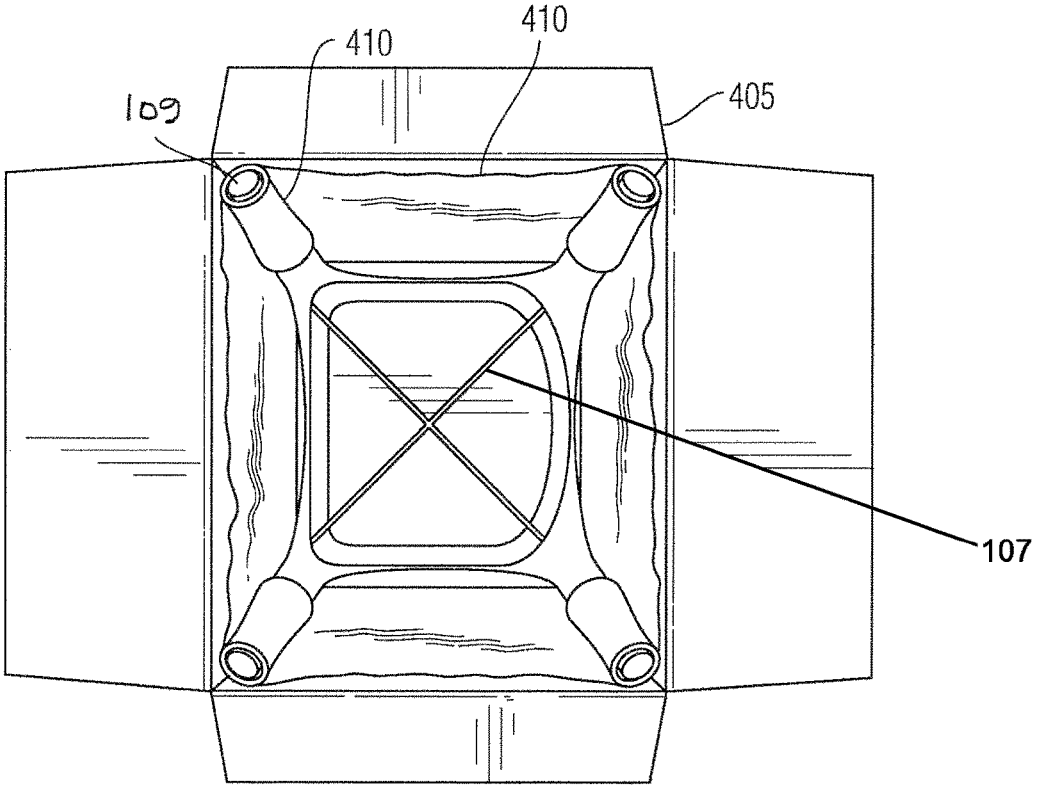
FIG. 5 is a top view of the chair seat as shown in FIG. 4.

FIGS. 4-7 show a shipping method for the chair of FIG. 3 in its disassembled state, which allows multiple chairs to be stored and shipped in one container. FIG. 4A shows a seat portion 105 arranged and placed in a shipping container 405 of suitable size with its seating surface 111 facing downward. FIG. 4B shows an alternative implementation in which multiple seat portions 105 are stacked together, arranged and placed in one shipment container 405. FIG. 5 is a top view of the box containing one or more seat portions 105. As shown in FIG. 5, other protection materials 410 can be included in the shipping container 405 to protect the chair surfaces. In some preferred implementations, protection materials 410 can be plastic bubble wraps and/or foam. Because the chair seat portions 105 are designed to stack one within the other, multiple seat portions 105 can be placed in a single container 405 depending on its height.

Figure 6A:
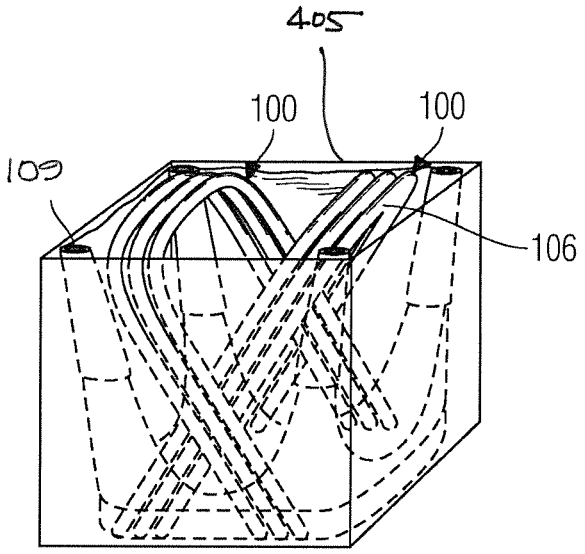
FIG. 6A is a partially-hidden perspective view of six backrest portions placed in the container of FIG. 4A.
Figure 6B:
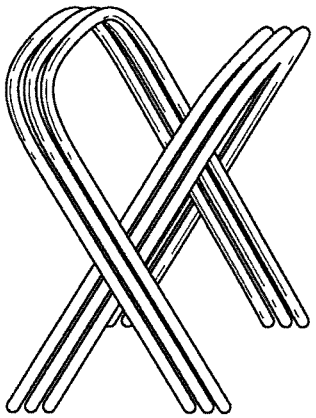
FIG. 6B is a perspective view of the multiple backrest portions of FIG. 6A stacked together and crossed.

FIG. 6A shows six backrest portions 100 arranged and placed in a shipping container 405 of suitable size. Typically the backrest portion 100 is placed in the container 405 after the seat portions 105 are stacked therein, so the backrest portion 100 has to be designed so that the distance between tubular side portions 101, 103 is less than the distance between the legs 109 of the seat portion 105. In some preferred implementations, each backrest portion 100 is arranged with its top portion 106 resting at one side of the shipping container 405 against the bottom ends of the inverted legs 109 of the uppermost seat portion 105 and its bottom portion placed at the diagonal opposite side from the top portion 106 against the upper ends of the inverted legs 109 of the seat portion 105. FIG. 6B shows how the backrest portions 105 are crossed and arranged in the shipment container 405 of FIG. 6A.

Figure 7:
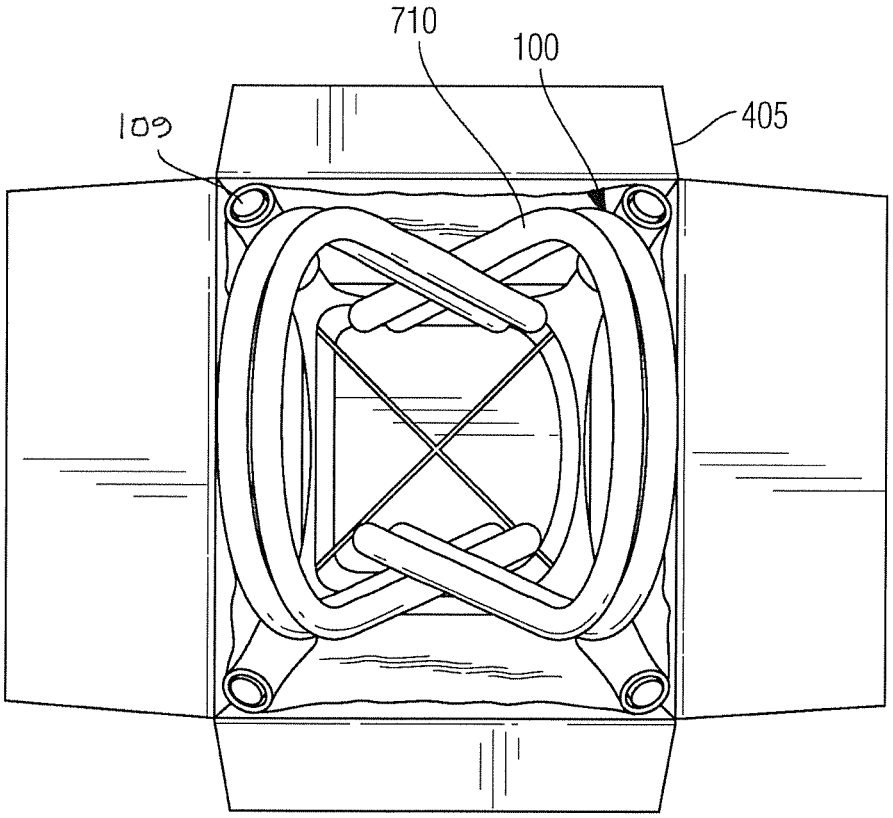
FIG. 7 is a top view of four backrest portions placed in the container inside the upstanding legs of the outermost seat portion of a stack of one or more nested seat portions.

FIG. 7 is a top view of the shipping container 405 containing one or more (in this case four) backrest portions 105 in crossed positioning on top of the outermost one or more stacked and nested seat portions 105 with extending legs 109. As shown in FIG. 7, other protection materials 710 can be included in the shipping container 405. In some preferred implementations, protection materials 710 can be plastic bubble wrap and/or foam. Optional backrest middle portion 104 can be arranged and stored in the spare space of the shipping container 405.

As shown in FIG. 7 the backrest portions 100 inclined on opposite sides are laterally offset from each other. With a slight increase in the width and height of the container 405, additional (i.e., more than four) backrest portions 100 can be included in one container 405. Similarly, because of the way the seat portions 105 stack, with a slight increase in height, additional (i.e., more than four) seat portions 105 can be included in the one container 405.

In some practical implementations, the present invention, namely, the seat portion 105, the backrest portion 100, the optional backrest middle portion 104, and the mechanical fasteners 110, can be made of wood, metal, plastic, or any combination of these materials. In some practical implementations, certain chair parts, namely the seat portion 105, the backrest portion 100, and the optional backrest middle portion 104, can be upholstered.

While the present invention has been particularly shown and described with reference to preferred embodiments thereof; it will be understood by those skilled in the art that various changes in form and details may be made therein without departing from the spirit and scope of the invention, and that the embodiments are merely illustrative of the invention, which is limited only by the appended claims. In particular, the foregoing detailed description illustrates the invention by way of example and not by way of limitation. The description enables one skilled in the art to make and use the present invention, and describes several embodiments, adaptations, variations, and method of use of the present invention.

What is claimed is:

1. A plurality of disassembled chairs configured to be combined in a stacked and nested arrangement for efficiently shipping them together in a single container without resorting to a flat-pack arrangement, each chair individually having an assembled state for use and a disassembled state for shipment in the container, the plurality of disassembled chairs comprising:

a plurality of seats, each seat constructed of a seating surface with an attached plurality of legs extending from the seating surface and diverging away from each other to partially enclose a nesting cavity between the legs from the seating surface to distal ends of the legs and sized so that a first seat with attached legs of the plurality of seats can be stacked and nested within the nesting cavity of a second seat with attached legs of the plurality of seats inside the container;

a plurality of backrests, each backrest configured to be assembled to a corresponding seat with attached legs to form an upright user support surface in the assembled state of the respective chair, each backrest configured so that a first backrest of the plurality of backrests corresponding to the first seat with attached legs of the plurality of seats and a second backrest of the plurality of backrests corresponding to the second seat with attached legs of the plurality of seats can both be placed entirely within the nesting cavity of the first seat with attached legs when the first seat with attached legs is stacked and nested in the nesting cavity of the second seat with attached legs in the container; and a plurality of fasteners configured to attach each backrest of the plurality of backrests to its corresponding seat with attached legs of the plurality of seats in the assembled state of each chair.

2. The plurality of disassembled chairs of claim 1 wherein the plurality of backrests are sized to be diagonally crossed with respect to each other within the outermost nested seat's nesting cavity.

3. The plurality of disassembled chairs of claim 1, wherein each seat is upholstered.

4. The plurality of disassembled chairs of claim 1, wherein each backrest and each seat is made of wood, metal, or plastic.

5. The plurality of disassembled chairs of claim 1, wherein each backrest is upholstered.

6. The plurality of disassembled chairs of claim 1, wherein each backrest defines a first connection hole and each seat defines a second connection hole.

7. The plurality of disassembled chairs of claim 6, wherein the first and second connection holes receive one of the fasteners.

8. The plurality of disassembled chairs of claim 1, wherein each backrest defines a first set of connection holes and each seat defines a second set of connection holes.

9. The plurality of disassembled chairs of claim 8, wherein each of the first and second sets of connection holes receives a respective plurality of the fasteners.

10. A method for shipping a plurality of disassembled chairs, comprising:

obtaining a plurality of disassembled chairs, each disassembled chair consisting of:

a seat constructed of a seating surface with an attached plurality of legs extending from the seating surface and diverging away from each other to partially enclose a nesting cavity between the legs from the seating surface to distal ends of the legs, and a brace under the seating surface connected to the plurality of legs;

a backrest sized, when disassembled from the seat, to fit entirely within the seat's nesting cavity; and a plurality of fasteners configured to attach the backrest to the seat;

obtaining a shipping container;

nesting the plurality of seats in the shipping container so that the seating surfaces are substantially parallel to each other; and placing the plurality of backrests entirely within an outermost seat's nesting cavity in the nested plurality of seats.

11. The method according to claim 10 wherein the placing step further comprises dividing the plurality of backrests into two groups, and crossing the two groups with respect to each other in the outermost nested seat's nesting cavity.

12. A kit for shipping disassembled chairs, comprising:

a plurality of disassembled chairs, each disassembled chair consisting of:

a seat constructed of a seating surface with an attached plurality of legs extending from the seating surface and diverging away from each other to partially enclose a nesting cavity between the legs from the seating surface to distal ends of the legs, and a brace under the seating surface connected to the plurality of legs;

a backrest sized, when disassembled from the seat, to fit entirely within the seat's nesting cavity; and a plurality of fasteners configured to attach the backrest to the seat; and a shipping container, wherein the plurality of seats are nested together inside the shipping container so that the seating surfaces are substantially parallel to each other, and wherein the plurality of backrests are disposed within an outermost seat's nesting cavity in the nested plurality of seats.

* * * * *